United States Patent [19]

Romíc et al.

[11] Patent Number: 4,492,076

[45] Date of Patent: Jan. 8, 1985

[54] PREPARATION DEVICE FOR MAKING A THREAD END READY FOR SPLICING

[75] Inventors: Ivica Romíc, Osijek, Yugoslavia; Jürgen Loos, Monchen-Gladbach, Fed. Rep. of Germany

[73] Assignee: W. Schlafhorst & Co., Monchen-Gladbach, Fed. Rep. of Germany

[21] Appl. No.: 458,160

[22] Filed: Jan. 14, 1983

[30] Foreign Application Priority Data

Jan. 15, 1982 [DE] Fed. Rep. of Germany ..... 3201049

[51] Int. Cl.[3] ..... D01H 15/00

[52] U.S. Cl. ..... 57/22

[58] Field of Search ..... 57/22, 261, 263

[56] References Cited

U.S. PATENT DOCUMENTS 2,515,172 7/1950 Abbott ..... 57/22

3,581,486 6/1971 Dibble ..... 57/22

4,263,775 4/1981 Mima ..... 57/22

4,397,140 8/1983 Sheehan et al. ..... 57/22

*Primary Examiner*—Donald Watkins

*Attorney, Agent, or Firm*—Herbert L. Lerner; Laurence A. Greenberg

[57] ABSTRACT

Make-ready device for making a first thread end ready for connection to a second thread end in a thread joining device, the make-ready device having a hollow body open at opposite ends thereof for receiving the first thread therein and traversible by a gas flow, includes at least one compressed gas guiding device for guiding the gas flow so as to at least partly stretch, parallelize and clean the fibers of the first thread in the hollow body, the compressed gas guiding device serving to control at least one of the nature and the direction of the compressed gas flow to the first thread end inside the hollow body, the compressed gas guiding device having a branch line connected to a compressed gas supply line and being continuously adjustably tappable with respect to at least the one of the nature and the direction of the compressed gas flow.

9 Claims, 5 Drawing Figures

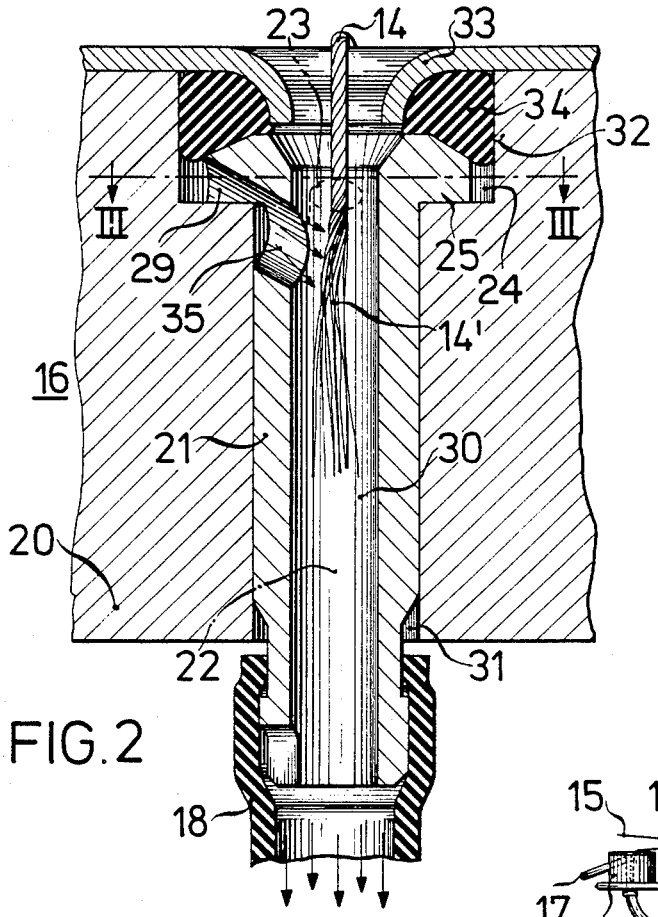
FIG. 2
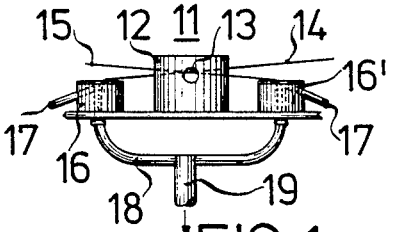
FIG. 1
FIG. 3
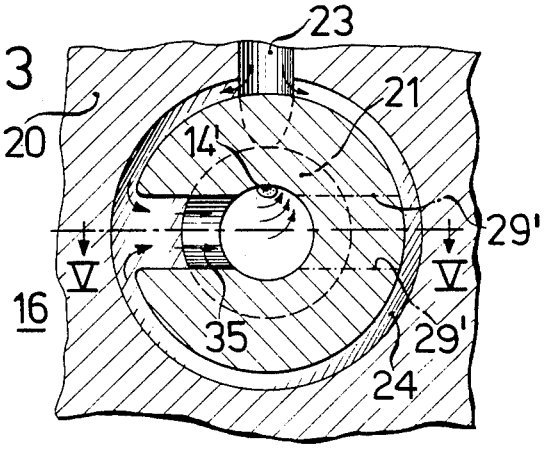

FIG. 4
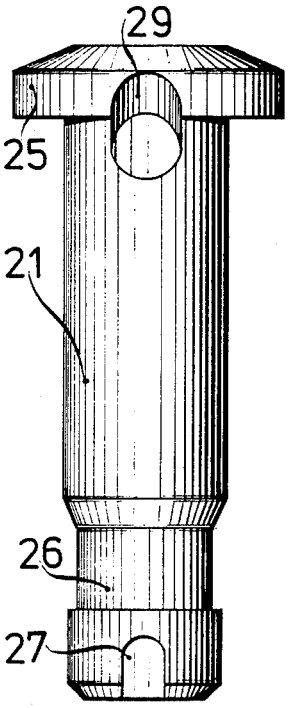
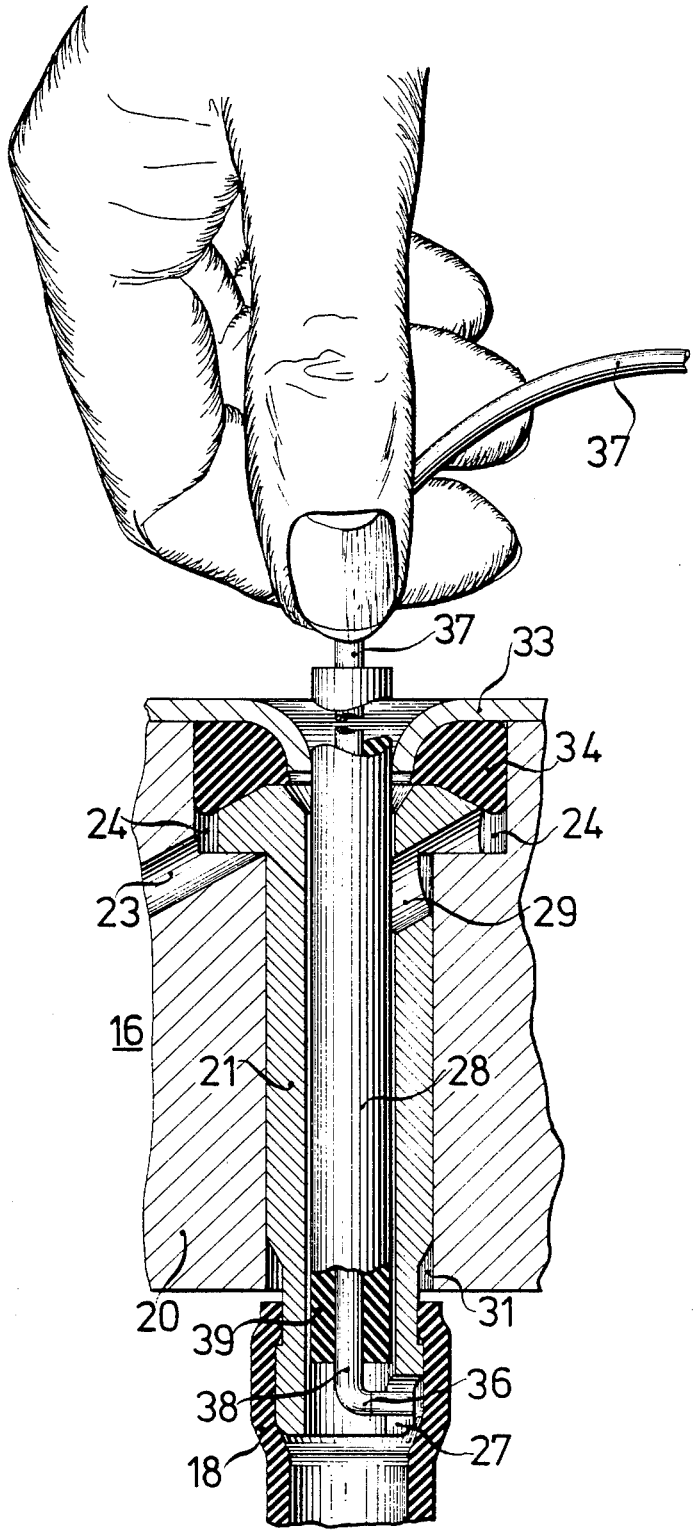
FIG. 5

PREPARATION DEVICE FOR MAKING A THREAD END READY FOR SPLICING

The invention relates to a make-ready or preparation device for making a thread end ready for connection to a second thread end in a thread joining device, the make-ready device having a hollow body open at opposite ends thereof for receiving the first thread therein and tranversible by a gas flow. If two thread ends, for example, are to be joined by splicing, it is necessary in certain cases first to stretch the fibers at least partly, to make them lie parallel to one another, i.e. parallelize them, and to remove short fibers therefrom. Generally, the threads have a twist which must be removed at the end regions thereof so that the individual fibers lie as parallel to one another as possible in stretched position thereof. Thread ends which have been prepared in this manner can then be connected to one another, for example, by splicing, the individual fibers of the two thread ends being alternatingly mixed, hooked, wound around one another, and finally also intertwined with one another by a reintroduced thread twist.

It has become known heretofore to achieve a stretch or parallelizing of the fibers by means of an air current or flow, or also by a flow of compressed air. For this purpose, the hollow body which receives the thread end may be provided with a device for conducting the compressed gas.

Difficulties do arise from the fact that, from case to case, the thread twist is of different amount, and also has a different direction from case to case. Therefore, it is not readily possible to provide a thread make-ready or preparation device which is universally applicable. Heretofore, the make-ready device had to be changed, at least if there was a change in the thread twist, and the device had to be exchanged for another one in each case.

The invention has the basic objective of providing an universally applicable make-ready device for the thread ends of differently twisted threads, which can readily be adjusted from one thread-twist to another, and can, in general, be adjusted for different thread properties, such as thread diameter, fiber material and fiber length.

Other objects of the invention are to provide such a make-ready device for making thread ends ready which can be quickly and accurately adjusted for different thread properties without having to exchange any parts to effect an optimal thread preparation, and thereby also an optimal thread connection.

With the foregoing and other objects in view, there is provided, in accordance with the invention, a make-ready device for making a first thread end ready for connection to a second thread end in a thread joining device, the make-ready device having a hollow body open at opposite ends thereof for receiving the first thread therein and traversible by a gas flow, including at least one compressed gas guiding device for guiding the gas flow so as to at least partly stretch, parallelize and clean the fibers of the first thread in the hollow body, the compressed gas guiding device serving to control at least one of the nature and the direction of the compressed gas flow to the first thread end inside the hollow body, the compressed gas guiding device having a branch line connected to a compressed gas supply line and being continuously adjustably tappable with respect to at least the one of the nature and the direction of the compressed gas flow.

In accordance with another feature of the invention, the branch line includes an annular channel surrounding the hollow body.

In accordance with a further feature of the invention, the compressed gas guide device has an element selectively and continuously connectible to a selective portion of the branch line.

In accordance with an added feature of the invention the hollow body is adjustable in position with respect to the compressed gas supply line.

In accordance with still a further feature of the invention the hollow body is of tubular construction and is mounted so as to be rotatable within a housing containing at least one of the compressed gas supply line and the branch line.

In accordance with an added feature of the invention the tubular hollow body is formed with a flange-like enlargement at an end thereof through which the first thread end enters into the hollow body.

In accordance with again an additional feature of the invention the housing is formed with an inner hollow cylindrical space for receiving the tubular hollow body therein, the inner cylindrical space merging at the thread entry end of the hollow body into an expanded hollow space of such dimensions that the branch line is formed as an annular channel between the flange-like enlargement and a defining wall of the expanded hollow space.

In accordance with still another feature of the invention there is provided a cover for the housing disposed at the first thread entry end, the tubular hollow body being rotatably connected with the housing by the cover.

In accordance with again an additional feature of the invention there is provided a ring-shaped seal formed of elastic material disposed between the cover and the flange-like enlargement of the tubular hollow body.

In accordance to a concomitant feature of the invention the hollow body is formed with a recess engageable by a tool for rotating the hollow body about the longitudinal axis thereof.

Before describing typical embodiments of the invention which are shown in the drawings, further objects and features of the invention are described hereinafter.

The compressed-gas conducting device controls the direction and condition or nature of the compressed gas current flowing toward the thread end in the interior of the hollow body. Generally, air is used as the compressed gas. However, sometimes for especially sensitive materials also a specially prepared compressed gas may be used, such as for example, predried compressed gas, compressed gas containing preparation agents, compressed gas which has been humidified (wetted), warmed, air-conditioned or the like. Devices for conducting the compressed gas are constructed, for example, in the form of nozzles, channels, small tubes or the like. What is especially novel in the invention is that the device for conducting the compressed gas is provided with conduction branches which are continuously adjustable for tapping with respect to the direction of the compressed gas flow. With respect to the direction, for example, the compressed gas stream can flow towards the thread, and the thread end, respectively either axially, helix-like or tangentially from one or the other end, or it can also impinge centrally upon the thread end. Also, mixed forms are possible.

According to the invention, the device for guiding the compressed gas is provided with a continuously adjustable tappable branch line system of which at least one branch line is always connected to a compressed gas supply line. The point at which the branch line system is tapped depends upon the expected conditions of the threads which are to be connected such as, for example, on the twist of the thread, the fiber material thereof, the strength thereof, or the like. At a batch change always that portion of the branch line system is tapped which suits that particular batch. Special means for tapping the branch line can be avoided if the hollow body is so constructed that it can be adjusted relative to the compressed gas supply line. This makes it possible to select the desired portion of the branch line by simply adjusting the position of the hollow body.

It is actually sufficient to provide only one compressed gas guide element, which by choice cna be connected with a selected portion of the branch line system. This contraction is especially applicable if the thread end which is to be made ready is not guided centrally into the hollow body but rather is guided along the wall or lies at the wall. In that case, the hollow body need be only slightly adjusted, to ensure that the compressed gas guide element thereof is directed tangentially toward the thread end one time from one end, and the other time from the other end.

The hollow body is especially easily adjustable relative to the compressed gas supply line if it has a tubular shape, and is rotatably supported in the housing, so that it can rotate around the longitudinal axis thereof. In this case, the housing contains either the compressed gas supply line, or branch line system, or contains the branch line system as well as the compressed gas supply line.

The construction of the make-ready device also takes the economical manufacture thereof into consideration. It has therefore been proposed in a further development of the invention that the branch line system be constructed in the form of an annular channel as mentioned hereinbefore. Such an annular channel can be produced with a lathe, for example.

The tubular hollow body can be provided with a flange-like enlargement at the thread entry end thereof. Such an enlarged portion has several advantages. For one, it prevents the hollow body from slipping through the housing, and for another, the aforementioned annular channel can be disposed around this flange-like enlargement. For this purpose, the housing is provided with a cylindrical bore for receiving the hollow body therein, the cylindrical bore being expanded at the thread entry end to such a diameter that the aforementioned annular channel is formed between the flange-like enlargement of the hollow body and a wall defining the expanded bore. In this regard it should be noted, that a compressed gas guide element penetrating the wall of the hollow body, for example, a bore formed for this purpose, is so disposed that it terminates in the annular channel. In any case, there must be always a connection from the annular channel to the interior of the tubular hollow body.

The tubular hollow body may be rotatably connected with the housing by means of a cover disposed at the thread entry end. This consequently prevents the tubular hollow body from slipping out of the housing unintentionally. On the other hand, it also ensures the central rotation of the hollow body. The aforementioned cover may be drawn in funnel-like to facilitate guiding the thread with the funnel wall thereof. The drawn-in cover can also serve simultaneously as a deflection point for the thread and the thread end, respectively. It is also advantageous, as mentioned hereinbefore, to arrange a ring-shaped seal of elastic material between the cover and the flange-like enlargement of the hollow body. Such a seal can serve two purposes. For one, it prevents the escape of compressed gas from the annular channel to the outside, For another, it applies a spring-like, yielding force to the hollow body, so that it assures the central adjustment thereof, yet also simultaneously introduces a friction locking closure, so that the hollow body, after it has been adjusted, does not change its position either by itself or due to the compressed gas flow.

Finally, as aforementioned, it is also advantageous to provide in the hollow body a recess for engagement therein by a tool used to effect the axial rotations. Such a tool may, for example, be a box spanner or socket wrench which is inserted into the tubular hollow body for making the adjustment, and which engages with a lug or nosepiece in the aforementioned recess. Other features which are considered as characteristic for the invention are set forth in the appended claims.

Although the invention is illustrated and described herein as embodied in a make-ready or preparation device for making a thread end ready, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic elevational view of a thread joining device with two thread make-ready or preparation devices constructed in accordance with the invention;

FIG. 2 is an enlarged fragmentary sectional view of FIG. 1 showing one of the thread make-ready devices;

FIG. 3 is a cross-sectional view of FIG. 2 taken along the line III—III in direction of the arrows and revolved through an angle of 90°;

FIG. 4 is a side elevational view of the hollow tubular body of the thread make-ready device; and FIG. 5 is a longitudinal sectional view of FIG. 3 taken along the line V—V as seen during adjustment of the position of the hollow tubular body.

Referring now to the drawing and, first, particularly to FIG. 1 thereof, there is shown a thread joining device 11 which is constructed as a thread splicing device. It has a splicing head 12 with a connection 13 to a non-illustrated compressed gas source. A thread 14 is positioned in the splice head 12, and terminates in a first thread make-ready or preparation device 16. A second thread 15 is also positioned in the splicing head 12, and terminates in a second make-ready or preparation device 16'. Both make-ready devices 16 and 16' are of similar construction. The make-ready device 16 is provided with a pressure gas connection or union 17'. A bifurcated hose line 18 connects both make-ready devices 16 and 16' to a gas outlet pipe 19.

After the thread ends have been made ready, as is yet to be described hereinafter, the two threads 14 and 15 are retracted to such an extent, by conventional means not further disclosed herein, that the thread endings lie side by side in the splicing head 12. Then a surge of compressed gas is applied through the compressed gas connection 13 into the splice head for making the splice or thread connection. The two thread ends are thereby joined to one another by a splicing process wherein the individual fibers are mutually entangled, intertwined and hooked to one another.

Further details of the preparation or make-ready device 16 according to the invention are shown in FIGS. 2 to 5.

In particular, FIGS. 2 and 5 show a housing 20, wherein a tubular hollow body 21 is supported so as to be rotatable about the longitudinal axis 22 thereof. The housing 20 is provided with a compressed-gas supply line 23 in the form of a bored channel, which is connected to the compressed gas connection 17. Furthermore, the housing 20 contains a line branch in the form of an annular channel 24. The annular channel 24 is connected to the compressed-gas supply line 23.

The tubular hollow body 21 is open at both ends thereof and has a flange-like enlargement 25 at the side end thereof at which the thread 14, 14' enters. It is clearly shown in FIG. 4 that the tubular hollow body 21, besides the flange-like enlargement 25, is formed with a circumferential groove 26 at the lower end thereof, which serves for holding and sealing the hose line 18. At the lower tip or edge, the tubular hollow body 21 is formed with a recess 27 for receiving therein a tool affording axial twisting of the hollow body 21. FIG. 4 also shows that a compressed-gas guide element 29 in the form of a bore slanted downwardly towards the longitudinal axis 22 is directed through the wall of the hollow body 21 in such a manner that also the flange-like enlargement has part of the bore 29 formed therein. A connection is thereby always provided between the inner hollow space 30 of the hollow body 21 and the annular channel 24.

According to FIG. 2, the housing 20 is formed with a cylindrical hollow space 31 for receiving therein the tubular hollow body 21, the hollow space 31 widening at the thread entry side into an enlarged space 32 of such dimensions that the herein aforementioned annular channel 24 is formed between the flange-like enlargement 25 and the wall defining the enlarged or widened space 32. The tubular hollow body 21 is rotatably connected with the housing 20 by a cover 33 which is disposed at the thread entry end. A ring-shaped seal 34 formed of elastic material is arranged between the cover 33 and the flange-like enlargement 25. The cover 33 is drawn in funnel-like so that the thread 14 with a radius which is not too small can be secured by the thread end 14' thereof in the make-ready device 16, in such a way that the thread end lies laterally at the inner wall of the hollow space 30, as shown in FIG. 3.

The annular channel 24 and the compressed gas guide element 29 together form an adjustable conduction or feed device for the compressed gas. This compressed gas conduction device has the capability to set or adjust, respectively, the pressure gas flow 35 traveling towards the thread ends 14' with respect to the type, direction, and strength thereof. This adjustment or setting, respectively, is effected by turning or twisting the hollow body 21 around the longitudinal axis 22 thereof. FIG. 3 shows that in the existing setting or adjustment, the compressed gas flow 35 travels tangentially towards the thread end 14' with a rotation towards the left hand side. The thread end 14' is thereby untwisted, and disrupted into individual fibers as shown schematically in FIG. 2.

FIG. 3 illustrates that, for example, the strength of the compressed gas flow can be increased by twisting or turning the hollow body 21 clockwise, because, the closer the compressed gas conduction element 29 approaches the compressed gas supply line 23, the smaller the resistance becomes. Additionally, the type of the compressed gas flow is changed because, as soon as the hollow body 21 is rotated through 90°, the guide element 29 is directed centrally towards the thread end 14', and a tangential flow condition is no longer in existence. If the hollow body 21 is rotated through 180 degrees, however, so that it assumes the position 29' indicated by the phantom lines in FIG. 3, there again exists a tangential flow towards the thread end 14', however, the flow then rotates towards the right-hand side. This position is also shown in FIG. 5. The tool 28 shown in FIG. 5 for adjusting the flow is formed of a key 36 having a handle 37. The shaft 38 of the key 36 has a rubber covering or sleeve 39. The rubber covering 39 ensures centering of the shaft 38 during the adjustment operation, and facilitates the insertion and withdrawal of the key 36 by sliding along the shaft.

The foregoing is a description corresponding to German Application No. P 32 01 049.4, filed Jan. 15, 1982, the International priority of which is being claimed for the instant application, and which is hereby made part of this application. Any discrepancies between the foregoing specification and the aforementioned corresponding German application are to be resolved in favor of the latter.

We claim:

1. Make-ready device for making a first thread end ready for connection to a second thread end in a thread joining device, the make-ready device having a hollow body open at opposite ends thereof for receiving the first thread therein and traversible by a gas flow, comprising at least one compressed gas guiding device for guiding the gas flow so as to at least partly stretch, parallelize and clean the fibers of the first thread in the hollow body, the compressed gas guiding device serving to control at least one of the nature and the direction of the compressed gas flow to the first thread end inside the hollow body, said compressed gas guiding device having a branch line connected to a compressed gas supply line and being continuously adjustably tappable with respect to at least the one of the nature and the direction of the compressed gas flow, said branch line comprising an annular channel surrounding the hollow body.

2. Make-ready device for making a first thread end ready for connection to a second thread end in a thread joining device, the make-ready device having a hollow body open at opposite ends thereof for receiving the first thread therein and traversible by a gas flow, comprising at least one compressed gas guiding device for guiding the gas flow so as to at least partly stretch, parallelize and clean the fibers of the first thread in the hollow body, the compressed gas guiding device serving to control at least one of the nature and the direction of the compressed gas flow to the first thread end inside the hollow body, said compressed gas guiding device having a branch line connected to a compressed gas supply line and being continuously adjustably tappable with respect to at least the one of the nature and the direction of the compressed gas flow, said compressed gas guide device having an element selectively and continuously connectible to a selective portion of said branch line.

3. Make-ready device for making a first thread end ready for connection to a second thread end in a thread joining device, the make-ready device having a hollow body open at opposite ends thereof for receiving the first thread therein and traversible by a gas flow, comprising at least one compressed gas guiding device for guiding the gas flow so as to at least partly stretch, parallelize and clean the fibers of the first thread in the hollow body, the compressed gas guiding device serving to control at least one of the nature and the direction of the compressed gas flow to the first thread end inside the hollow body, said compressed gas guiding device having a branch line connected to a compressed gas supply line and being continuously adjustably tappable with respect to at least the one of the nature and the direction of the compressed gas flow, the hollow body being adjustable in position with respect to the compressed gas supply line.

4. Make-ready device for making a first thread end ready for connection to a second thread end in a thread joining device, the make-ready device having a hollow body open at opposite ends thereof for receiving the first thread therein and traversible by a gas flow, comprising at least one compressed gas guiding device for guiding the gas flow so as to at least partly stretch, parallelize and clean thefibers of the first thread in the hollow body, the compressed gas guiding device serving to control at least one of the nature and the direction of the compressed gas flow to the first thread end inside the hollow body, said compressed gas guiding device having a branch line connected to a compressed gas supply line and being continuously adjustably tappable with respect to at least the one of the nature and the direction of the compressed gas flow, the hollow body being of tubular construction and being mounted so as to be rotatable within a housing containing at least one of the compressed gas supply line and said branch line.

5. Make-ready device according to claim 4 wherein said tubular hollow body is formed with a flange-like enlargement at an end thereof through which the first thread end enters into said hollow body.

6. Make-ready device according to claim 5 wherein the housing is formed with an inner hollow cylindrical space for receiving said tubular hollow body therein, said inner cylindrical space merging at the thread entry end of said hollow body into an expanded hollow space of such dimensions that said branch line is formed as an annular channel between said flange-like enlargement and a defining wall of said expanded hollow space.

7. Make-ready device according to claim 5 including a cover for the housing disposed at the first thread entry end, said tubular hollow body being rotatably connected with said housing by said cover.

8. Make-ready device according to claim 7 including a ring-shaped seal formed of elastic material disposed between said cover and said flange-like enlargement of said tubular hollow body.

9. Make-ready device for making a first thread end ready for connection to a second thread end in a thread joining device, the make-ready device having a hollow body open at opposite ends thereof for receiving the first thread therein and traversible by a gas flow, comprising at least one compressed gas guiding device for guiding the gas flow so as to at least partly stretch, parallelize and clean the fibers of the first thread in the hollow body, the compressed gas guiding device serving to control at least one of the nature and the direction of the compressed gas flow to the first thread end inside the hollow body, said compressed gas guiding device having a branch line connected to a compressed gas supply line and being continuously adjustably tappable with respect to at least the one of the nature and the direction of the compressed gas flow, the hollow body being formed with a recess engageable by a tool for rotating the hollow body about the longitudinal axis thereof.

* * * * *